US008756736B1

(12) United States Patent
Minson

(10) Patent No.: US 8,756,736 B1
(45) Date of Patent: Jun. 24, 2014

(54) INCLINED AIR MATTRESS HAVING INTERNAL AIR BAFFLES AND SUPPORTS

(71) Applicant: Kelli L. Minson, Spring, TX (US)

(72) Inventor: Kelli L. Minson, Spring, TX (US)

( * ) Notice: Subject to any disclaimer, the term of this patent is extended or adjusted under 35 U.S.C. 154(b) by 0 days.

(21) Appl. No.: 14/013,823

(22) Filed: Aug. 29, 2013

(51) Int. Cl.
*A47C 27/08* (2006.01)

(52) U.S. Cl.
CPC ..... *A47C 27/081* (2013.01)
USPC ..... 5/711; 5/706

(58) Field of Classification Search
CPC ..... A47C 27/081; A61G 7/05769; A61G 7/05776; A47G 9/1027
USPC ..... 5/706, 711, 712, 682, 644, 654, 655.3
See application file for complete search history.

(56) References Cited

U.S. PATENT DOCUMENTS

| | | | | |
|---|---|---|---|---|
| 1,132,056 | A * | 3/1915 | Wesley et al. | 4/455 |
| 1,156,523 | A * | 10/1915 | Clemens | 5/630 |
| 2,198,804 | A * | 4/1940 | Carlsson | 604/356 |
| 2,612,645 | A * | 10/1952 | Boland | 5/644 |
| 3,503,084 | A * | 3/1970 | Meinwieser | 5/630 |
| 4,592,589 | A * | 6/1986 | Hellwig | 297/452.41 |
| 4,920,591 | A * | 5/1990 | Sekido et al. | 297/287 |
| 4,928,336 | A * | 5/1990 | Petillo, Sr. | 5/644 |
| 4,965,899 | A * | 10/1990 | Sekido et al. | 297/284.6 |
| 4,998,301 | A * | 3/1991 | Markus | 4/457 |
| 5,645,319 | A * | 7/1997 | Parks, Jr. | 297/391 |
| 6,478,380 | B2 * | 11/2002 | Ehrlich | 297/423.46 |
| 6,659,552 | B2 * | 12/2003 | Duncan | 297/230.1 |
| 7,607,185 | B1 | 10/2009 | Minson | |
| 8,656,540 | B2 * | 2/2014 | Chen | 5/711 |
| 8,661,590 | B2 * | 3/2014 | Chen | 5/711 |
| 2002/0125758 | A1 * | 9/2002 | Duncan | 297/452.41 |
| 2013/0145560 | A1 * | 6/2013 | Chen | 5/711 |
| 2013/0180052 | A1 * | 7/2013 | Chen | 5/711 |

FOREIGN PATENT DOCUMENTS

| | | | | |
|---|---|---|---|---|
| GB | 2205236 | A * | 12/1988 | A47C 27/08 |

* cited by examiner

*Primary Examiner* — Robert G Santos
(74) *Attorney, Agent, or Firm* — Davidson Berquist Jackson & Gowdey LLP

(57) ABSTRACT

The invention is an inflatable, wedge-shaped incline mattress that uses internal air baffles to present an inclined sleep surface of uniforms gradient to help relieve Gastric Esophageal Reflux Disease (GERD).

3 Claims, 6 Drawing Sheets

INCLINED AIR MATTRESS HAVING INTERNAL AIR BAFFLES AND SUPPORTS

FIELD OF THE INVENTION

The present invention generally relates to inflatable mattresses, more specifically inclined mattresses having internal air baffles and supports and the construction of the same.

BACKGROUND INFORMATION

GERD, or Gastric Esophageal Reflux Disease, is a backflow of acid and undigested material from the stomach into the swallowing tube or esophagus. In most patients this is due to a transient relaxation of the "gate" or lower esophageal sphincter (LES) that keeps the lower end of the esophagus closed when a person is not swallowing food or liquids. The esophagus is not able to cope with acid as well as the stomach and is easily injured. This acid can irritate and sometimes damage the lining on the inside of the esophagus. In some cases, untreated GERD can facilitate the occurrence of Esophageal Cancer.

GERD has a pronounced recurrent character and it generates symptoms such as heartburn, throat inflammation and soreness, difficulty swallowing and difficulty breathing. Obviously, anything that puts pressure on the abdomen, such as tight belts or girdles, can worsen the problem and GERD can be aggravated by a number of factors, including alcohol, tobacco, medications containing aspirin, obesity and stress. When a person lies down to sleep or in particular lies down right after eating, it is easier for food and acid to come back into the esophagus and throat.

Chronic laryngitis, hoarseness, sleep apnea, laryngospasm, wheezing, chronic cough, frequent throat clearing, and snoring are all likely to occur if a person suffers from night-time reflux (GERD), labeled more accurately as Sleep-time Reflux. When lying flat on the back, the stomach is above the esophagus, which, as a result, allows acidic stomach contents to flow more easily through a weakened LES into the esophagus and on to the pharynx where it may also follow a path of least resistance to the trachea and sinus cavities. The end result is some or all of the above mentioned symptoms of GERD.

According to the U.S. Dept of Health and Human Services (National Institutes of Health, NIH Publication #94-1447), 1 in 33 or 3.00% or 8.2 million people in the United States alone suffer from Gastric Esophageal Reflux Disease (GERD) and 60% of babies born every year in the United States are born with GERD. The most common immediate recommendation by doctors in the U.S. for adults with GERD is to elevate the head of the bed 6 to 8 inches.

The most common recommendation by pediatricians to parents with newborns suffering from GERD is to keep the infant in an upright sitting position at all times—including sleep time. This often means that these newborns spend almost all of their time being held by an adult or in a car seat or carrier because of the incline position of these devices. Adults also attempt to combat GERD by stacking pillows under their heads and upper bodies or by using a short, shoulder supporting foam wedge under these same areas. But this propping does not work because the feet are still not lower than the stomach and GERD symptoms can be worse when the body bends at the waist. With these approaches, the stomach contents can be trapped above the LES and the symptoms continue or worsen. Also, in the propped up from the waist position, the person may only sleep in one position—on the back—and the short wedge or the mountain of pillows must be stored during the day as the bed cannot be made with them in place.

Most or all relevant devices are ineffective primarily because they only serve to elevate the head while not lowering the feet relative to the stomach, and/or limit sleeping to only the back position throughout the sleeping period. It is desirable to have an inflatable incline mattress that is inexpensive, portable, allows the bed to be made as it remains in place, or, alternatively, easily stored and even transported for use elsewhere. Further it is beneficial for individuals to sleep in many positions, and effectively relive GERD by elevating the head without causing the user's body to bend at the waist. It was for this reason that the present inventor, Minson, filed for and obtained U.S. Pat. No. 7,607,185 directed to such an inflatable, inclined air mattress.

Because the relative body elevations are critical to combating GERDS using such a mattress, prior internal air bladder and air baffle designs proved inadequate. Providing an inclined sleep surface without bulges or voids proved important to avoiding dips in the mattress in the area of the user's hips. If the user's hips sink into the mattress, as can happen with larger users or when some of the air leaks out of the mattress, then the user can bend at the waist while sleeping. Accordingly, a new air baffle and support design was needed to combat this problem, even when the inclined mattress is accommodating two users in the same bed.

SUMMARY OF THE INVENTION

In view of the foregoing, it is an object of the present invention to provide an inflatable incline mattress having internal air bladder and air baffle configuration design to provide a uniform inclined sleeping surface.

It is a further object of the invention to provide an air mattress design to maximize its durability and ability to hold air and maintain its form.

In satisfaction of these and related objects, the present invention is an inflatable incline mattress that is inexpensive, portable, easily inflated or deflated, allows for sleep in many positions, and effectively relives GERD in adults or infants. The subject invention, however, in other embodiments, need not achieve all these objectives and the claims hereof should not be limited to structures or methods capable of achieving these objectives.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

FIG. 2 illustrates the construction and placement of the air baffles within the mattress of the present invention in hidden line.

DETAILED DESCRIPTION OF THE PREFERRED EMBODIMENT

Figure 1:
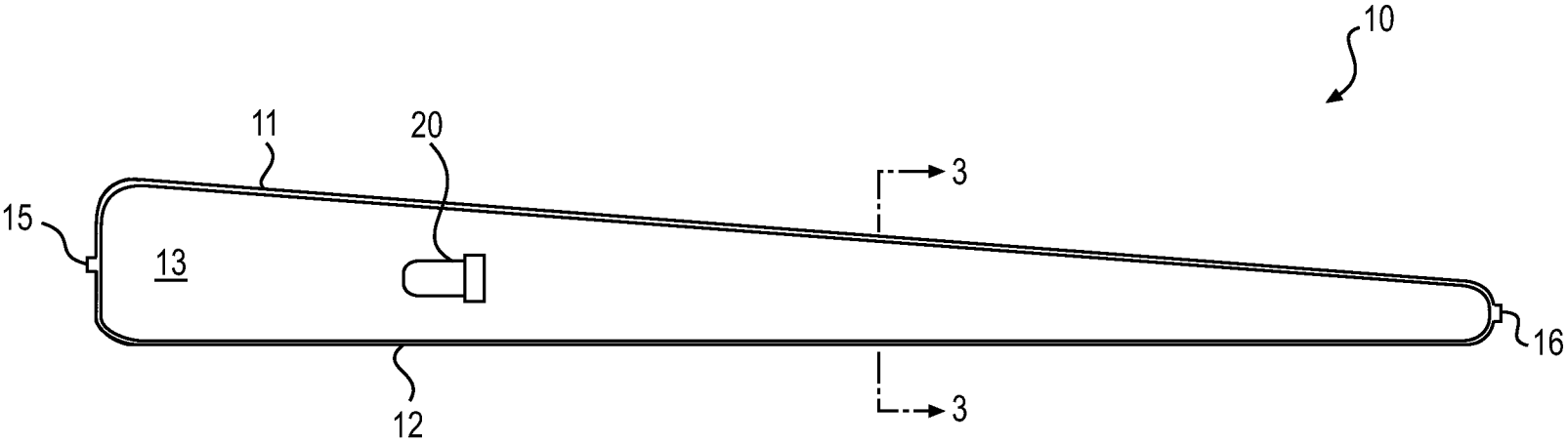
FIG. 1 shows a side view of an inflated king size (78 inches wide by 80 inches tall) version of the present invention in a preferred embodiment.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. It is to be understood that other embodiments may be utilized and structural changes may be made without departing from the scope of the invention. Moreover, the claims hereof are not to be read restrictively unless there is clear and convincing evidence manifesting a certain exclusion, restriction, or disclaimer.

In the preferred embodiment of the invention, inclined mattress 10 is sized to coordinate with standard bed sizes. For example, in order to maximize the ability to use existing sheets, blankets and bed covers, the inclined mattress of the present invention will be provided in at least king, queen, double, twin, and infant crib sizes. As shown in FIG. 1, the mattress at the top or head of the mattress adjacent the top seam 15 is much thicker in cross section than at the opposite end of the mattress, commonly called the bottom or foot of the mattress, adjacent the bottom seam 16. In the preferred embodiment of the invention, the inclined mattress 10 is about 10 inches in height from the bottom surface 12 to the top surface 11 (in the area adjacent top seam 15), and about 3 inches in height measuring from the bottom surface 12 to the top surface 11 at the foot bottom edge) (foot or bottom of the mattress). These dimensions provide for an optimal uniform gradient of about 30 degrees from top to bottom. For a king sized mattress, the mattress 10 is about 78 inches from side to side and about 80 inches from head to foot.

The height of the mattress of the preferred embodiment thus varies by about 7 inches in total height differential from head to foot, providing a substantially uniform gradient from the foot of the mattress to the head of the mattress. Of course, in much smaller mattresses, such as those found in baby cribs, the difference in thickness is much less given the smaller size of the crib mattress. This incline lowers the feet, but raises the head, relative to the stomach of a person laying on the mattress (a loaded condition), and uses gravity to help keep the contents of the stomach moving in a normal downward direction without causing the body to bend at the waist. Ideally, the incline gradient should be such that the sleeper's head (not shown) is elevated between about 5 or 6 inches, and the sleeper's stomach (not shown) is elevated above the user's feet and below the upper body. The resultant configuration is an elongated wedge shape.

In the preferred embodiment of the invention, an electric, motor-driven, two-way, air in/air out pump (not shown) can be housed within the mattress 10 in side wall 13 of mattress 10, or attached to an air inlet/outlet plug 20 in that same area of the mattress. That pump can be battery powered or plug into a standard building power supply. The pump can be used to force air into mattress 10 or to remove air from that mattress to facilitate rapid deflation.

Figure 2:
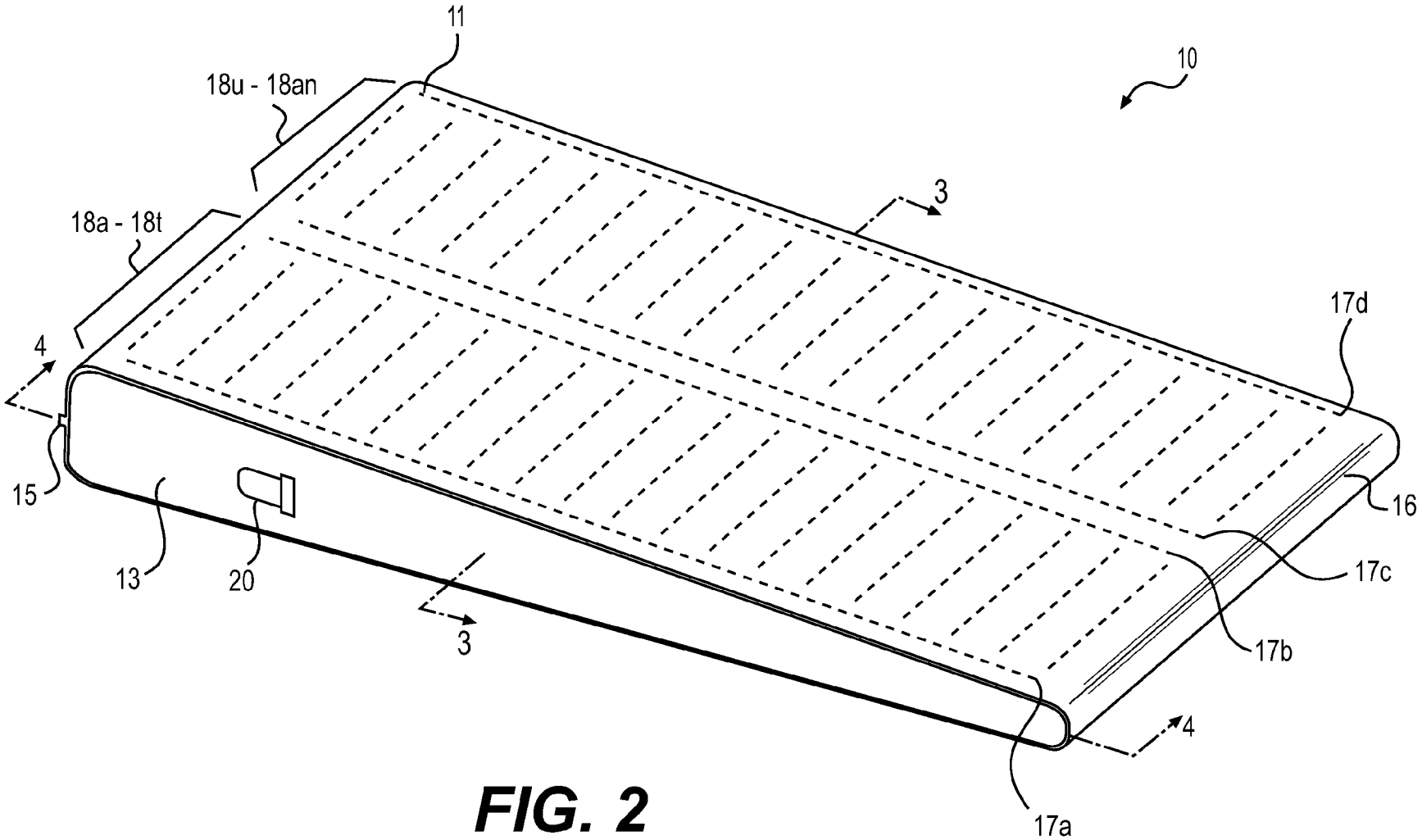
FIG. 2 is a superior view of the preferred embodiment of the invention.

The body (chamber) of the inclined sleep surface air mattress 10 of the present invention is constructed of, for example, fabric laminated poly-vinyl chloride (PVC). As shown in FIGS. 1 and 2, mattress 10 is constructed of four separate panels, top 11, bottom 12, right side panel 13 (in which the air inlet/outlet port 20 is installed), and left-side panel 14. In the presently preferred embodiment, each of these four panels are constructed of fabric laminated PVC. The top panel 11 and the bottom panel 12 are fasten together at the top seam 15 and bottom seam 16 to create an open loop shape using known connection methods. In the preferred embodiment, these connections are made by sonic weld. Similarly, side panels 13 and 14 are connected to top panel 11 and bottom panel 12 to enclose an internal volume in mattress 10 into which air can be inserted to inflate the mattress or removed to deflate that mattress. Sonic welding is the preferred connection method for each of these connections.

Figure 3:
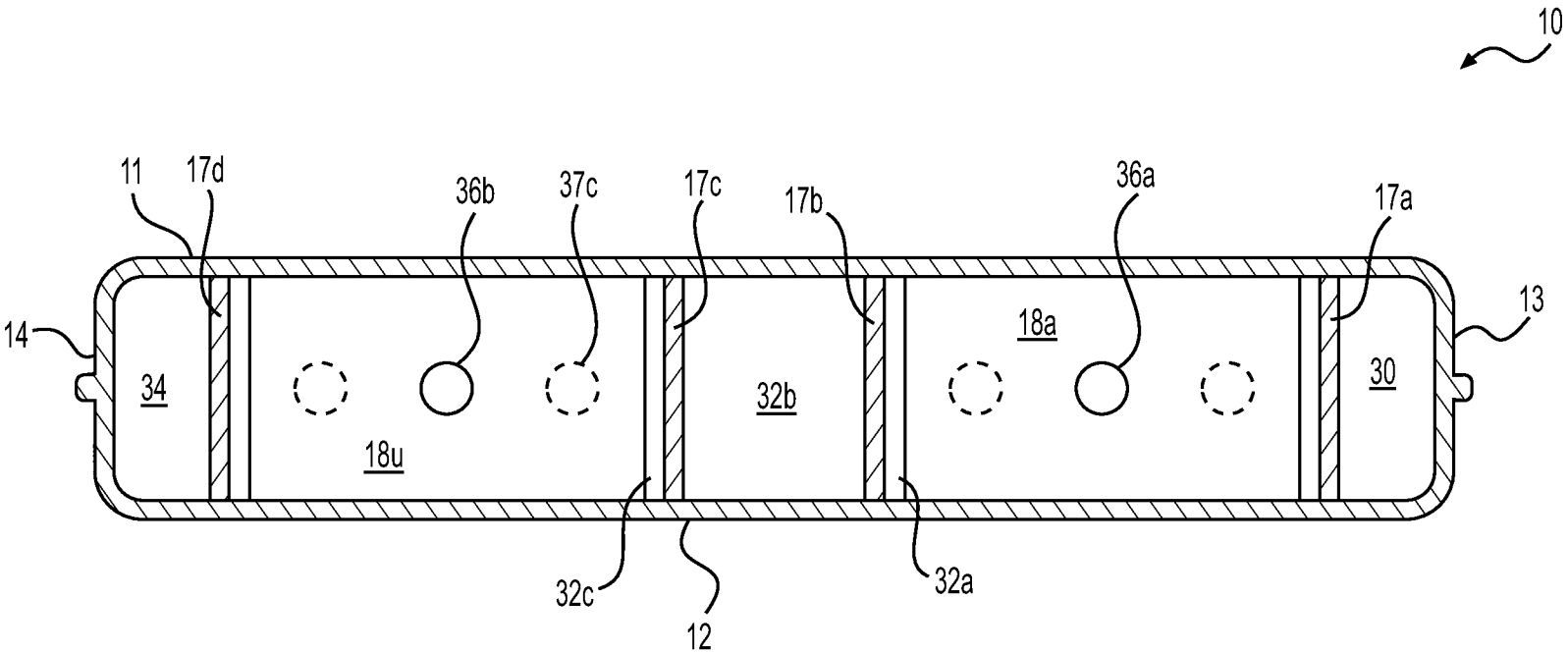
FIG. 3 is a cross-sectional view of the preferred embodiment of the invention taken along line 3-3 of FIG. 2 showing the construction and placement of the longitudinally-extending internal air baffles within the mattress of the present invention.
Figure 6:
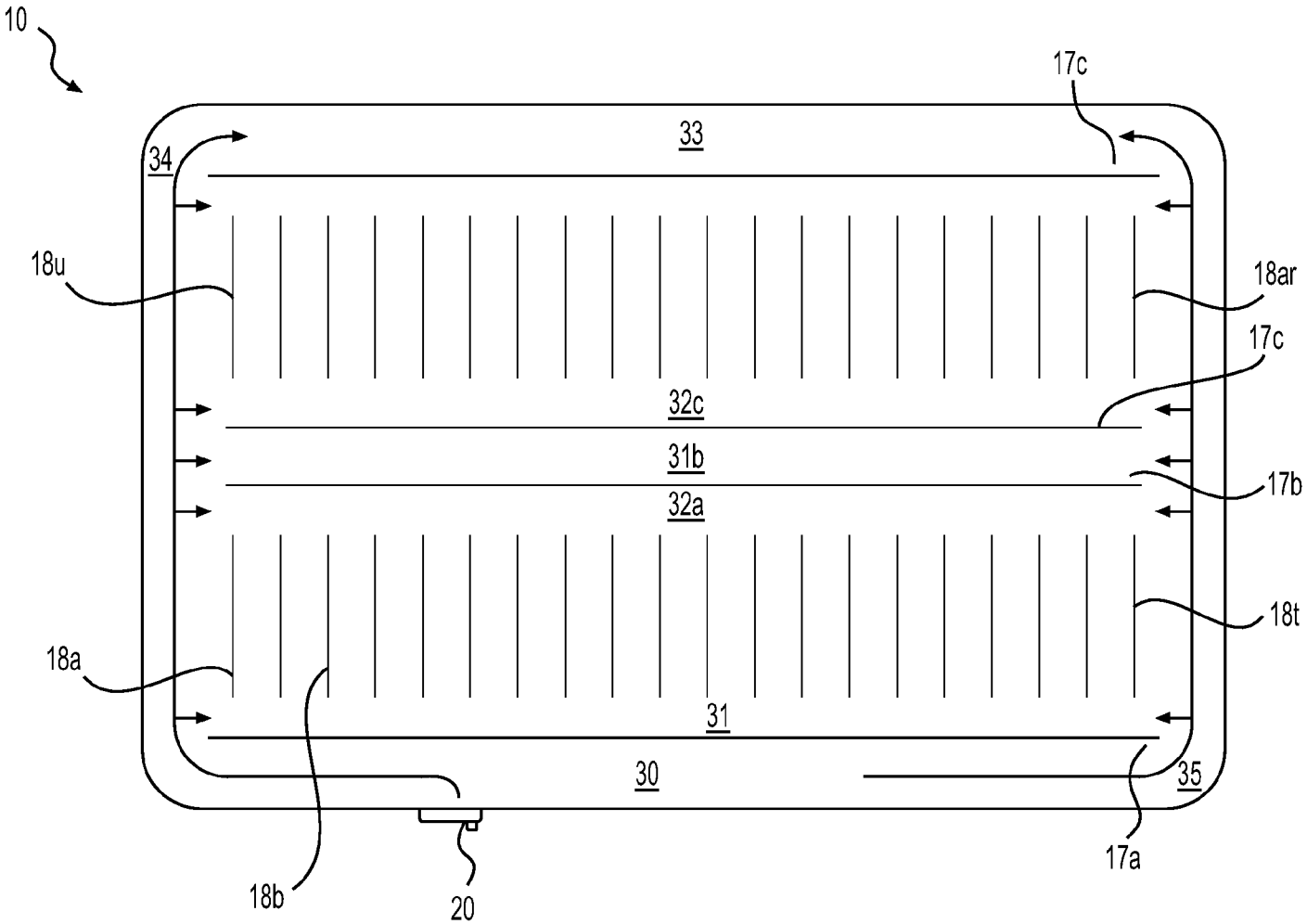
FIG. 6 is a representational view of the air flow within king-sized variant of a preferred embodiment of the invention.

Turning to the internal construction of the preferred embodiment of mattress 10, four longitudinally-extending air baffles 17*a* through 17*d* are used to divide mattress 10 interior into 6 longitudinally-extending air channels 30, 31, 32*a-c* and 33, two horizontally-extending air channels 34 and 35, which serve as air headers at the top and bottom of the mattress, as best shown in FIGS. 3 and 6. In the king-sized mattress of the preferred embodiment, all four of these longitudinally-extending air baffles extend to within approximately 3 inches of the bottom weld 16 between the upper panel 11 and lower panel 12 and to within approximately 10 inches of the top weld 15 between those same two panels. Each of these longitudinally-extending air baffles are preferably constructed of a pliable PVC material which is sonically welded to both the top panel 11 and the bottom panel 12 so as to form a barrier to the horizontal movement of air within mattress 10 except through in the areas adjacent the top-most and bottom-most portions of mattress 10 near top seam 15 and bottom seam 16. With longitudinal baffles 17*a* through 17*d* in place, air entering mattress 10 will be directed towards the top and bottom portions of mattress 10, with those portions of mattress 10 serving as headers for distributing air throughout the remaining parts of mattress 10. The route taken by the incoming air is shown best in FIG. 6.

Horizontally-extending air baffles are also employed in the mattress of the preferred embodiment. As shown in hidden line in FIG. 2 and in cross-section in FIG. 4, a plurality of horizontally-extending air baffles are employed to create two separate horizontally-extending zones of sleep support in the case of a king-size mattress. As best shown in FIG. 2, the king-sized bed depicted employs approximately 40 air baffles 18*a* through 18*an*. In the preferred embodiment of the king-sized mattress, these air baffles divide the bed into two sets of 21 horizontally-extending support zones. These horizontally-extending baffles are placed approximately 3 to 4 inches apart and each one is sonically welded to both the top panel 11 and the bottom panel 12. The distal ends of each horizontal air baffle 18*a* through 18*t* of the preferred embodiment of the present invention extend to within approximately one half an inch of the most adjacent pair of longitudinally-extending air baffles, air baffles 17*a* and 17*b* with the other set of horizontally-extending air baffles 18*u* through 18*an* sharing the same spacing with longitudinally-extending air baffles 17*c* and 17*d*. This air baffle placement is illustrated in FIG. 2.

Along with longitudinally extending air baffles 17*a*-17*d*, horizontal air baffles 18*a*-18*t* and 18*u*-18*an* create support for the inclined sleep surface formed by top panel 11 and restrict movement of air within the mattress in order to maintain a uniform gradient inclined sleep surface. As noted above, to effectively combat GERDS, the user's head should be at an elevation higher than the stomach, and the stomach should be at a higher elevation that the feet. The optimal incline of the preferred embodiment is 30 degrees from the horizon. Because it is important to avoid bending at the user's waist, the maintenance of a uniform gradient is important. The present invention seeks to maintain the uniformity of that gradient when the mattress is in use by restricting the movement of air within the mattress.

Figure 5B:
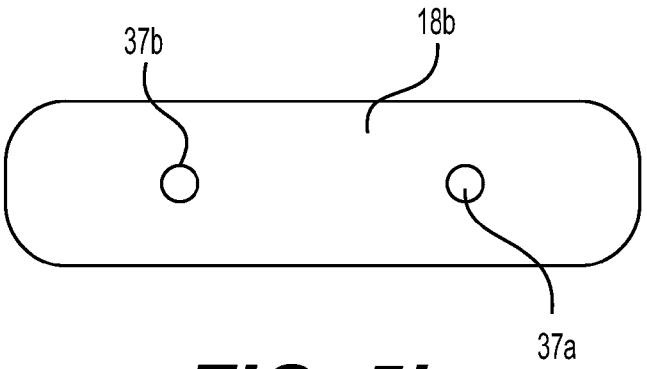
FIG. 5*a* is a frontal view of one variant of a horizontally-extending air baffle of a preferred embodiment of the invention and FIG. 5*b* is a frontal view of a second variant of a horizontally-extending air baffle of a preferred embodiment of the invention.
Figure 5A:
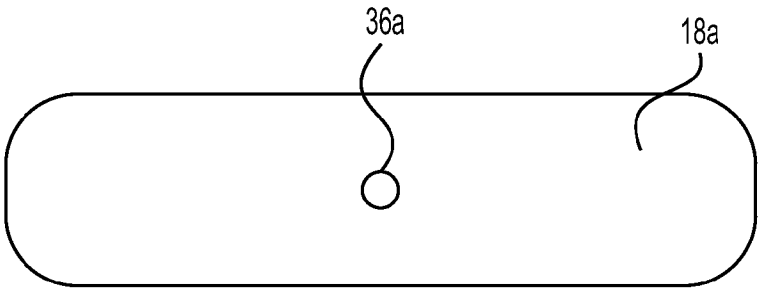

As best shown in FIGS. 5*a* and 5*b*, each of the horizontally-extending air baffles are solid PVC panels. As shown in FIG. 5*a*, half of the horizontally-extending air baffles, for example air baffle 18*a* shown, has one central opening 36*a* through which air can move. Horizontally-extending air baffle 18*u* includes a single centrally-located opening 36*b*. As shown in FIG. 5*b*, the other half of the horizontally-extending air baffles, for example air baffle 18*b* shown in hidden lines in FIG. 3 and in FIG. 5*b*, have two spaced openings, 37*a* and 37*b*, through which air can move. It is through these openings, as well as the approximately one-half inch wide air channels created by the placement of the horizontally-extending air baffles 18*a*-18*an* relative to the longitudinally-extending air baffles 17*a*, 17*b*, 17*c* and 17*d*, that air can pass to facilitate inflation and deflation of mattress 10. The air movement that occurs within mattress 10 during inflation is depicted in FIG. 6 (with inflation air circulation depicted by arrows).

Figure 4:
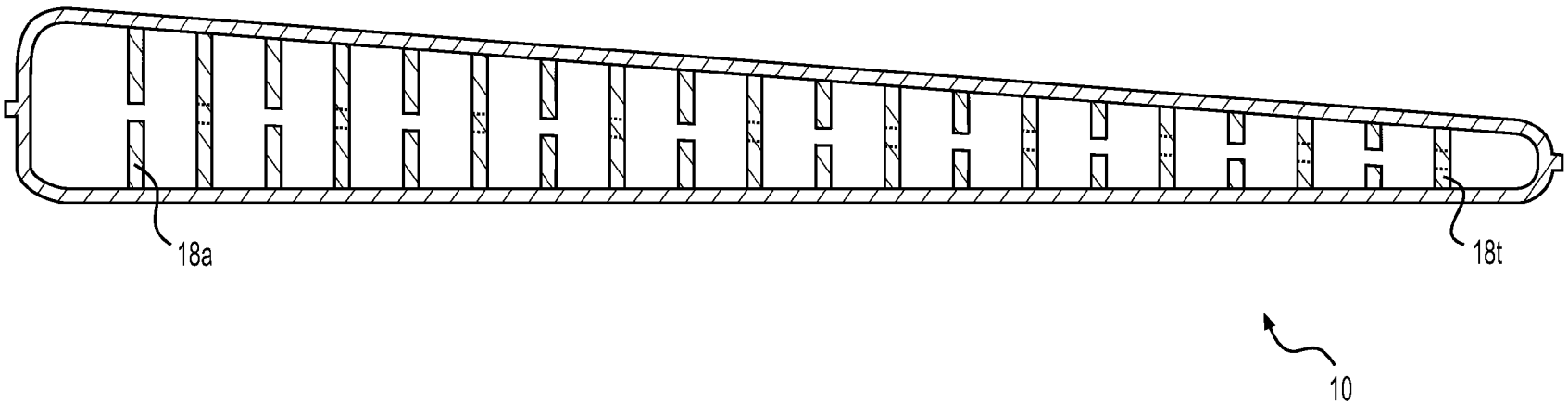
FIG. 4 is a cross-sectional view of the preferred embodiment of the invention taken along line 4-4 of FIG. 2.

FIGS. 3 and 4 illustrate how the two types of horizontally-extending air baffles are alternately employed in the preferred embodiment of the invention. In FIG. 3, horizontally-extending air baffles 18*a* and 18*u* are shown in place within mattress 10. These two air baffles include centrally-located air passages 36*a* and 36*b*, respectively. Shown behind, in hidden lines, are the air passages 37*a*-37*d*, of the next horizontally-extending air baffles, 18*b* and 18*v*, respectively. The alternate arrangement of horizontally-extending air baffles is also shown in FIG. 4. Given the inclined sleep surface of the invention, the horizontally-extending air baffles vary in height, with the shortest baffles 18*t* and 18*an* being placed closest to the bottom of the bed and the tallest baffles 18*a* and 18*u* being placed closest to the top of the bed. The changing height of the air baffles is shown in FIG. 4.

The provision of multiple horizontally-extending air baffles 18*a*-18*t* and 18*u*-18*an* and the restrictions to air flow within mattress 10 contribute to ensuring the desired uniform gradient of the sleep surface. The movement of air from a support zone under greater pressure from the user results in the movement of air from the area under the user's greatest weight causing higher pressure in the immediate sleep support zone, along with tension on the horizontally-extending air baffles most adjacent the area where the user's weight causes the most displacement. Although each horizontally-extending air baffle increases production costs and product weight, these air baffles are placed approximately 3 to 4 inches apart in the preferred embodiment of the invention, in order to support the user's body (not shown) and minimizing bulges and depressions in mattress 10 which can cause the user's body to bend at the waist. In the king-sized version of the preferred embodiment, this spacing results in the use of 20 horizontally extending air baffles on each side of the king-sized bed. Of course, beds of other sizes have differing dimensions, with smaller beds, such as twin-sized beds, having only a single sleep support zone.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

I claim:

1. An inflatable mattress having a sleep surface having a uniform gradient comprising:

a top mattress panel, a bottom mattress panel, a longitudinally-extending right side panel and a longitudinally-extending left side panel, connected together with airtight seams to form an air bladder adapted to inflate upon insertion of a gaseous fluid;

a sealable air port adapted to selectively facilitate insertion and removal of said gaseous fluids into and out of said air bladder, said air bladder being arranged to form a bed mattress sized to substantially cover a standard size bed and, when said air bladder is properly inflated, said bottom mattress panel forms a generally planar surface suitable for placement on top an existing bed and said top panel mattress forms an inclined sleeping surface, said inclined sleeping surface having a relatively uniform gradient;

at least two longitudinally-extending air baffles connected between said top mattress panel and said bottom mattress panel by airtight seams, each of said longitudinally-extending air baffles being spaced apart from said right and left side panels and having a length shorter than a length of said right and left side panels; and a plurality of horizontally-extending air baffles connected between said top mattress panel and said bottom mattress panel by airtight seams, each of said plurality of horizontally-extending air baffles extending between said at least two longitudinally-extending air baffles leaving approximately one-half of an inch between each distal end of each of said plurality of horizontally-extending air baffles and said at least two longitudinally-extending air baffles, each of said plurality of horizontally-extending air baffles having a unique height from said bottom mattress panel to said top mattress panel to support an inclined sleep surface having a uniform gradient;

wherein, placement of said at least two longitudinally-extending air baffles and said plurality of horizontally-extending air baffles supports said uniform gradient of said inclined sleep surface by resisting movement of air within said mattress.

2. An inflatable incline mattress as in claim 1, wherein said uniform gradient is 30 degrees from horizontal.

3. An inflatable incline mattress as in claim 2, wherein said mattress is 7 inches thicker at one extreme edge than at the opposite extreme edge when said mattress is fully inflated.

* * * * *